US006244856B1

(12) United States Patent
Winnington et al.

(10) Patent No.: US 6,244,856 B1
(45) Date of Patent: Jun. 12, 2001

(54) BURNER ASSEMBLIES

(75) Inventors: Terence Leslie Winnington, Stroud; Thomas Somervell, Birmingham, both of (GB)

(73) Assignee: Interotex Limited, Berkshire (GB)

( * ) Notice: Subject to any disclaimer, the term of this patent is extended or adjusted under 35 U.S.C. 154(b) by 0 days.

(21) Appl. No.: 09/242,476

(22) PCT Filed: Aug. 8, 1997

(86) PCT No.: PCT/GB97/02141

§ 371 Date: Feb. 18, 1999

§ 102(e) Date: Feb. 18, 1999

(87) PCT Pub. No.: WO98/08027

PCT Pub. Date: Feb. 26, 1998

(30) Foreign Application Priority Data

Aug. 20, 1996 (GB) ..... 9617444

(51) Int. Cl.[7] ..... F23N 5/08

(52) U.S. Cl. ..... 431/79; 431/21; 431/168; 431/88; 431/326; 126/926

(58) Field of Search ..... 431/79, 78, 77, 431/75, 80, 88, 21, 170, 7, 168, 189, 159; 126/92 R, 92 AC, 905, 92 C; 165/104.18, 89, 87; 236/15 R, 15 BB, 15 BE, 15 BR, 15 A, DIG. 5; 137/72

(56) References Cited

U.S. PATENT DOCUMENTS

| | | | | |
|---|---|---|---|---|
| 1,677,156 | * | 7/1928 | Vaughn | 431/328 |
| 3,274,579 | * | 9/1966 | Fuller, Jr. | 431/80 |
| 3,558,114 | * | 1/1971 | Saeman | 236/15 R |
| 3,857,669 | * | 12/1974 | Smith et al. | 431/328 |
| 3,857,670 | * | 12/1974 | Karlovetz et al. | 431/329 |
| 4,639,213 | * | 1/1987 | Simpson | 431/326 |
| 4,790,744 | * | 12/1988 | Bellet et al. | 431/75 |
| 5,122,054 | * | 6/1992 | Debacque et al. | 431/21 |
| 5,326,257 | * | 7/1994 | Taylor et al. | 431/329 |

FOREIGN PATENT DOCUMENTS

| | | | |
|---|---|---|---|
| 0 681 143 | * | 11/1995 | (EP) . |
| 1 206 660 | * | 2/1960 | (FR) . |

* cited by examiner

*Primary Examiner*—Ira S. Lazarus
*Assistant Examiner*—Josiah C Cocks
(74) *Attorney, Agent, or Firm*—Young & Thompson

(57) ABSTRACT

A burner assembly includes a number of gas burners each utilizing a radiant ceramic plaque, the burners are disposed in confined combustion chambers where they direct heat towards a heat-receiving surface so that by this arrangement the plaque receives a substantial amount of back radiation.

16 Claims, 2 Drawing Sheets

BURNER ASSEMBLIES

BACKGROUND OF THE INVENTION

This invention relates to burner assemblies and in particular, but not exclusively, to burner assemblies for delivering heat to a rotary heat pump or other rotary heat receiver. It is emphasized however that the invention extends to burner assemblies for general use; and particularly to radian plaque burners with low NOx emissions.

DESCRIPTION OF THE RELATED ART

A rotary heat pump is described in U.S. Pat. No. 5,009,085, and further developments are described in our published International Patent Application No. WO 97/14924, the contents of which are incorporated herein by reference. In U.S. Pat. No. 5,009,085 a putative burner geometry is proposed in which a burner receives gas and air and is fitted with radiant plaques which emit the energy of combustion in approximately equal amounts of radiant heat and heat contained in the combustion products. The heat energy omitted from the stationary plaques impinges on the rotary dished plate of the heat pump generator. Hot flue gas from the burner flows over the outer surface of the generator and then is expelled via an annular slot. In the region of the slot, heat transfer to the generator plate is primarily by forced convection.

SUMMARY OF THE INVENTION

We have built and tested burner assemblies similar to those described in U.S. Pat. No. 5,009,085 but have found that the burner efficiency is relatively low, around 60%, to such an extent that jeopardises the prospects of a commercially viable heat pump.

Two further problems were encountered in attempting to follow the teachings of U.S. Pat. No. 5,009,085; firstly the apparent need to provide a gap of precisely defined thickness between the rotating generator surface and the burner housing, and secondly the need to provide a satisfactory support for the burner housing which is cantilevered to reach over the convexly dished generator surface.

A further design objective in this invention is to provide a burner assembly which provides sufficient heat but which does not have unacceptably high levels of NOx emissions. The formation of NOx in combustion is a complex process involving the reaction of oxygen, nitrogen and other species within the flame. In general the amount of NOx formed depends upon the temperature conditions in the flame and the residence time of the reacting species at the high temperatures.

Although some fuels contain significant quantities of nitrogen-bearing compounds, which can lead to NOx production, the levels in natural gas are very low and so the predominant source of nitrogen for NOx formation is the combustion air.

There are generally recognised to be two mechanisms for NOx formation. These are known as Fenimore NOx (F-NOx) or prompt NOx and Zeldovich NOx (Z-NOx) or thermal NOx. F-NOx is formed very rapidly in a flame, but in a fully pre-mixed flame will only be significant at sub-stoichiometric conditions. Z-NOx is strongly temperature dependent and is formed later in the flame. In a fully pre-mixed lean combustion Z-NOx is the predominant mechanism and is the reason why most NOx reduction strategies concentrate on the time and temperature dependence of this mechanism.

However, the Z-NOx temperature dependency is only strong at flame temperature conditions above about 1600° C. and most blue gas flames contain temperature conditions above 2000° C. In lean combustion, the oxygen in the air will continue to form NOx beyond the flame (i.e. when the combustion reactions are complete) if the temperatures are high enough.

Fully pre-mixed radiant plaque burners are increasingly being used in gas appliances because of their good turndown and low NOx characteristics. In a ceramic radiant plaque burner, the gas is fed into a plenum chamber closed by a ceramic plaque which may be porous or provided with an array of apertures. In general these burners operate in two distinct modes (although the transition is not a sharp one). At lower heat inputs the burner surface radiates strongly and the flame is very short, close to the plaque surface. At higher heat inputs the flame temperature and flame length increase and the plaque surface temperature may be lower the burner is said to be in blue flame mode.

When not in blue flame mode, ceramic radiant plaque burners have inherently low NOx characteristics because the flames are very short and temperatures are low as heat is dissipated from the flame by the radiating surface In most applications radiant plaques only operate with very low NOx levels at relatively modest thermal loadings (<300 kW/m$^2$). Increasing throughput results in longer flames, higher local flame temperatures and increasing NOx emissions as the burner goes towards the blue flame condition. Nevertheless, even in blue flame mode the NOx emissions from ceramic radiant plaques can be significantly lower than conventional metal burners, because the plaque still has a flame temperature reduction and flame shortening effect.

We have found that, surprisingly, by designing a burner assembly in which a ceramic plaque burner is generally enclosed, with a significant amount of heat being radiated back from the enclosure and the heated surface, the NOx emissions for a given heat output can be significantly reduced thus allowing either reduced NOx emissions or a higher heat output for a given threshold of NOx.

Accordingly, in one aspect of this invention, there is provided a burner assembly comprising a radiant plaque burner means disposed within a generally enclosed chamber or a generally confined volume and directing radiant heat to a heat receiving means.

By this arrangement, we have found that it is possible to raise the limiting heat throughput of a given burner before the NOx reaches a set limit. We have found that enclosing the burner tends to raise the temperature of the radiant plaque thereby increasing reaction rates and tending to shorten the flame length. We also found that this feature can reduce flame temperature, thereby again reducing NOx. A further benefit of shortening flame length is that it allows the radiant plaque burner means to be located closer to the heat-receiving means without causing flame impingement. In a conventional arrangement, without the substantial amount of back-radiation, the flame length is greater and so the distance at which flame impingement occurs is greater. Flame impingement causes the combustion reactions to be quenched, resulting in unacceptably high CO emission levels.

In a preferred embodiment of this invention, the NOx forming reactions are quenched, reducing NOx emission levels, but the combustion reactions are already completed at a shorter distance from the burner means.

In a preferred embodiment, said heat receiving means comprises a continuous surface extending beyond the periphery of the burner means.

Preferably, the walls of the chamber and/or said heat-receiving surface return a significant component of the radiant heat developed by said burner means, thereby further to increase the temperature of the plaque. The temperature of the plaque is preferably over 700° C. and more preferably around 1000° C. By raising the temperature of the plaque surface above conventional levels, e.g. by return of the back-radiation, combustion reaction rates are increased, thereby tending to reduce the flame length and delaying the onset of flame lift.

Another advantage of increasing the temperature of the plaque is that it may be increased to the levels to activate one or more catalysts in the plaque to stabilise the flame and reduce NOx levels. Thus in a preferred embodiment, the plaque may incorporate one or more catalysts such as platinum, palladium, alumina.

Certain available plaques already contain a substantial quantity of alumina, though not for its possible catalytic properties as it is not active in the normal operating temperatures.

In such an arrangement, the burner is converted so that the surface pores are hot enough to initiate catalytic action while the flame length is short enough and close enough to the plaque to be stabilised by the catalytic action. In addition, the forward velocity of the fuel/air mixture must be high enough and the thermal conductivity of the plaque must be low enough to avoid light back.

Preferably, the inner walls of said enclosed chamber have a relatively high reflectivity and/or emissivity (thereby to enhance the amount of re-radiated absorbed heat).

Although we do not exclude the possibility of operating the burner in blue flame mode, it is preferred to operate it in short flame mode, to minimise or reduce NOx emissions.

The radiant plaque burner means preferably comprises a ceramic fibre plaque element. The elements may have an array of bores defining flame outlets or the element may have a porous structure, e.g. a mat, through which the combustion mixture passes.

Preferably, the outer surface of the plaque element of the radiant plaque burner is textured or patterned, e.g. with a corrugated, undulating or tessellated surface, thereby to enhance absorption of back-radiation and thereby raise the surface temperature. In this way, flame lift can be delayed, and so the usual increase of flame temperature with increased heat input may be reduced, so reducing the production of NOx at around 0.05 $kW/cm^2$.

Although a wide range of heat throughput is possible, it is preferably in the range of from 0.01 to 0.5 $kW/cm^2$ per unit surface area of plaque, and ideally around 0.1 $kW/cm^2$.

For this level of heat throughput, for a typical methane/air mixture, the volume flow rate of gas/air pre-mix through the plaque may be in the range of from 0.00017 $m^3$/min per $cm^2$ to 0.0085 $m^3$/min per $cm^2$ unit surface area of plaque and ideally around 0.0017 $m^3$/min per $cm^2$.

According to another aspect of this invention there is provided a burner assembly comprising a radiant plaque burner means and one or more radiative elements disposed in sufficiently close proximity to said radiant plaque burner means to return a significant component of the radiant heat developed by said burner means, thereby further to increase the temperature of the plaque with a consequent increase in the rates of the combustion reactions and shortening of the flame. The radiative elements may conveniently comprise the walls of the burner chamber, and/or inserts of suitable material such as ceramic material positioned in front of the burner means. Also where the burner is designed to deliver heat to a heat-receiving surface, the surface itself may provide a significant component of back-radiation. Indeed, the flame-shortening effect may allow the burner means to be positioned closer to the heat receiving-surface thereby increasing yet further the back-radiation emitted therefrom.

Accordingly to another aspect of this invention, there is provided a method of operating a radiant plaque burner to reduce the NOx emissions thereof, which comprises causing a significant component of the radiant heat developed by said burner means to be returned to said radiant plaque burner, thereby further to increase the temperature of the plaque, with a consequent increase in the rates of the combustion reactions and shortening of the flame.

In another aspect, this invention provides a burner assembly for a rotary heat pump which comprises a rotary housing mounted for rotation about a rotation axis and defining a heat-receiving surface for receiving heat from said burner assembly, said burner assembly including one or more radiant burner devices spaced from and directed towards said heat-receiving surface, and a cowl means disposed around said burner device or devices, and projecting towards said heat-receiving surface to define a generally enclosed combustion chamber and thereafter extending closely spaced from said surface to define a narrow gap through which burner efflux may pass, wherein said cowl means is constrained against rotation with said housing.

In this arrangement, the generally enclosed combustion chamber provides significant back radiation of heat onto the radiant burner device. Furthermore, the burner assembly is preferably configured so that, with typical operating burner exhaust rates, and rotational rates of the heat pump, a surprisingly energetic laminar boundary layer is established at a relatively small distance from the heat-receiving surface and so heat transfer to the heat receiving surface is not significantly affected with substantial variations in the gap.

Preferably, the cowl means includes a cowl element formed of a mineral wool, ceramic fibre material, or other heat resistant material such as glass. Preferably, said cowl element is made by vacuum-forming from a slurry of mineral wool fibres.

The cowl means preferably includes a reinforcing member for being rotatably coupled to said housing, or a shaft or the like attached thereto. The reinforcing member may comprise a central stub or shaft portion from which project a plurality of generally radial reinforcing elements, which extend towards said heat-receiving surface. The reinforcing member and elements are preferably made of metal.

Preferably, the or each burner device is attached to and supported by said cowl means, conveniently between adjacent reinforcing elements, and preferably not directly attached thereto.

Preferably the periphery of the cowl means terminates adjacent a surface of the housing which extends generally axially, thereby defining an annular outlet whereby the burner efflux exhausts with a substantial axial component. This feature avoids conditions favouring a reverse flow of external (cold) air into the narrow gap.

Preferably, said narrow gap extends for at least a third and preferably about a half of the radial dimension of the cowl, thus providing an extended gap and a compact combustion chamber with enhanced back-radiation.

Preferably, the inner walls of the cowl means extend generally axially, closely to surround the radiant surface of said radiant burner device or devices. Preferably, the average axial spacing $D_A$ of the front surface of the radiant device or devices from the facing surface of the heat-receiving surface is between about 30% and 70% of the radial dimension $D_R$ of the heat emitting surface of the burner device. Again these features contribute to a compact combustion chamber providing significant amounts of back-radiation.

In the designs of rotary heat pump described in U.S. Pat. No. 5,009,085 and published International Patent Application No. WO 97/14924, the heat applied by the burner assembly to the generator is transferred by spraying a stream of working fluid over the inner surface of the generator. If for any reason this flow should be interrupted the generator surface will quickly overheat with potentially disastrous consequences. Another possible system malfunction is if the igniter for the radiant burner devices fails to operate properly, as the burner will then be discharging a potentially explosive mixture.

In the past, the temperature of the generator surface has been monitored using one or more thermocouples but these require the signal to be relayed across a rotating interface and this may be problematic.

We have found that it is possible to use an optical sensor to detect modulation of the radiation conditions within the combustion chamber to determine one or more possible malfunctions.

Accordingly, in another aspect, this invention provides a burner assembly comprising a combustion chamber including burner means for producing radiant heat, a rotary housing defining a heat-receiving surface for receiving heat from said chamber, and a sensor means constrained against rotation with said rotary housing for detecting radiation in said chamber, and processor means responsive to the amplitude of or modulation of said detected radiation to monitor operation of said assembly.

The optical sensor and processor means may respond to modulation arising from a number of effects. Thus, in one embodiment, the heat-receiving surface may have one or more tab elements projecting therefrom and formed of a fusible material or secured to the heat receiving surface by a fusible material and disposed such that, on rotation of said housing, the burner means radiation is modulated by said tab means. In this arrangement the processor means may detect the change in modulation caused by detachment of said tab elements if the temperature of said receiving surface exceeds the melting temperature of the fusible material. The fusible material may comprise a solder of composition selected to provide a required melting temperature. Where the burner means includes an igniter element, the igniter tab elements and optical sensor may be disposed such that, on actuation of said igniter means, the processor looks for the corresponding modulation in the output signal of the optical sensor and thereby monitors both correct operation of the igniter means as well as checking for previous overheating of the heat-receiving surface.

The optical sensor and processor are preferably also operable to determine from the amplitude of the radiation present in the combustion chamber whether said burner means is alight.

As noted above, in the enclosed burner design developed for the heat pump, the NOx levels are significantly lower than those in conventional plaque burners. The requirement to reduce or minimise NOx emissions is of course a general requirement for all burners and not simply those intended for delivering heat to a rotary surface. The invention therefore extends to a general form of radiant plaque burner with reduced NOx emissions.

Whilst the invention has been described above, it extends to any inventive combination or subcombination of the features set out above or in the following description.

BRIEF DESCRIPTION OF THE DRAWINGS

The invention may be performed in various ways and, by way of example only, an embodiment and various modifications thereof will now be described by reference to the accompanying drawings, in which.

DETAILED DESCRIPTION OF THE INVENTION

Figure 1:
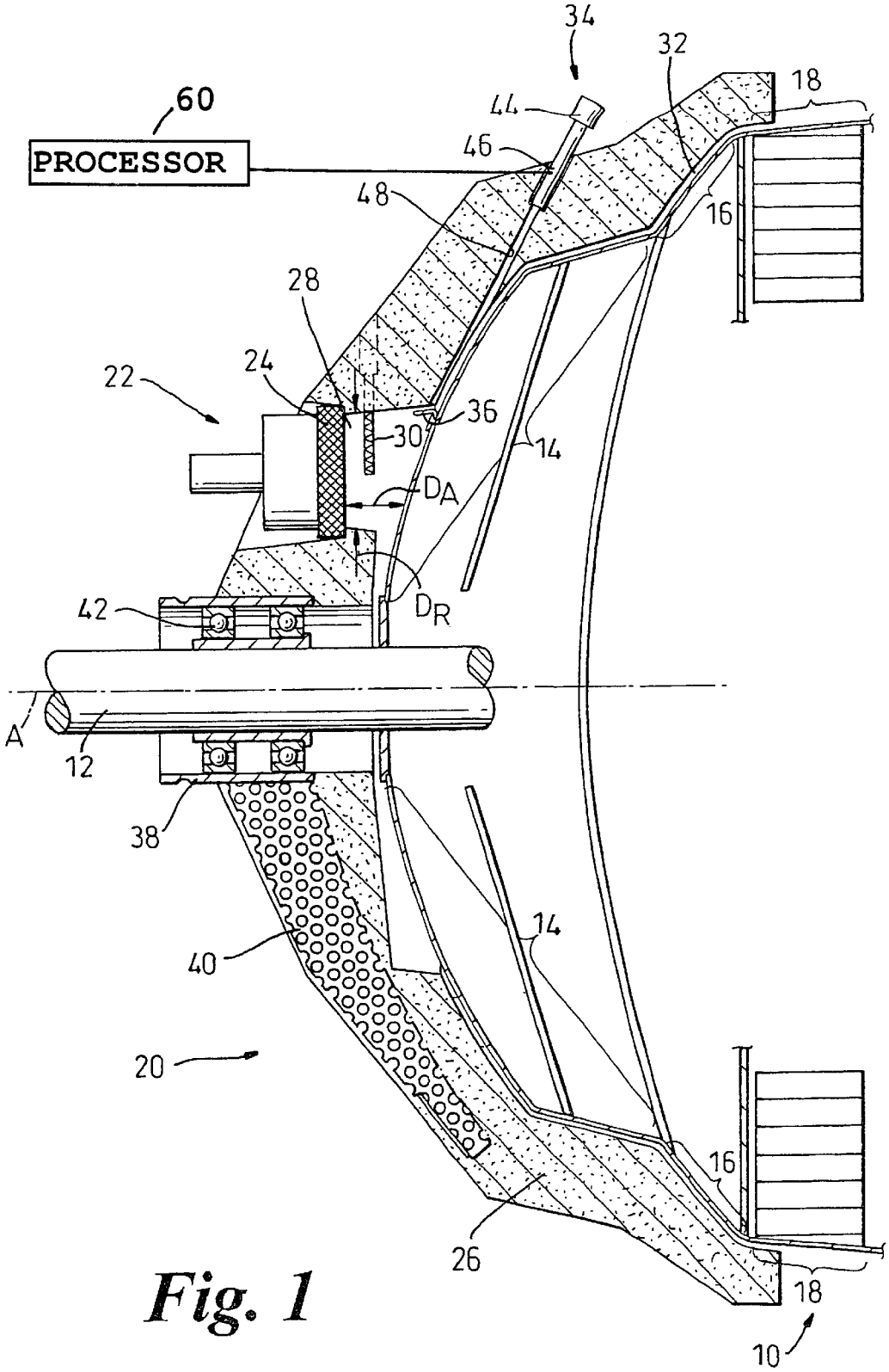
FIG. 1 is a vertical section view of a burner assembly for delivering heat to the generator surface of a rotary heat pump.

The burner assembly described here is intended to provide heat to the heat-receiving end of a heat pump such as described in our published International Patent Application No. WO 97/14924, but as described below, the principles of the design may be utilised in more general applications.

Referring to the drawings, the heat pump comprises a rotary housing 10 mounted on a shaft 12 for rotation about a rotational axis A. The convexly curved, stepped, surface of the rotary heat pump housing shown in the Figure defines a primary generator/condenser region 14, an intermediate generator region 16 and a solution heat exchanger region 18. In operation, the major proportion of the heat developed is absorbed by the primary generator/condenser region 14, although useful proportions are also absorbed by the secondary generator 16 and the solution heat exchanger 18 regions.

The burner assembly 20 consists of a number (typically 4) of gas burners 22 utilising ceramic radiant plaques 24, arranged around the axial shaft 12 of the machine. The burners are mounted in a fixed mineral wool fibre cowl 26, which is located concentrically with the shaft 12 and extends radially outwards to enclose regions 14, 16 and 18 of the generator housing.

The burners 22 are each arranged to fire into a combustion chamber 28 in front of the primary generator surface 14. They are supplied with a fully pre-mixed air and gas mixture and ignited by means of an electrical hot surface element 30 located in the combustion chamber.

The cowl 26 is designed to fit closely to the generator shape, such that the combustion product gas is passed through a narrow gap 32 between the stationary cowl 26 and the rotating generator surface. In this particular embodiment, the narrow gap 32 extends for approximately half the inner radial dimension of the cowl 26.

To protect the generator surface 14 from overheating, an optical sensor system 34 is employed together with metal tabs 36 soldered to the generator surface.

The gas burners 22 are designed to operate in a short flame mode such that the surfaces of the radiant plaques 24 are very hot (typically 1000° C.) and produce a high level of infra-red radiation. The rotation of the housing 10 relative to the cowl 26 means that a laminar boundary layer of gas is established in a very small radius. Although this limits the effectiveness of the heat transfer by convection from the impinging hot gases, because the natural gas products of combustion are largely transparent, the heat transfer by infra-red radiation is substantially unimpaired. By operating the burner in a short flame mode, NOx formation is kept to low levels. The configuration of the burners 22 is such that they receive a significant amount of back-radiation from the generator surface 14 and from the inner surface regions of the fibre cowl 26, which form the remainder of the combustion chamber 28. This has the effect of increasing the plaque surface temperature, (compared with firing the burner in the open). This rise in temperature is accompanied by an increase in the rates of the combustion reactions and a further shortening of the flame. This allows the throughput of the burner to be increased to a higher level before the flame length grows to a point where the local flame conditions exceed the Z-NOx threshold temperature (about 1600° C.). Thus the illustrated embodiment of burner assembly is capable of operation with very low NOx levels at higher thermal loadings. Significant increases in NOx formation will occur only when the flame temperature exceeds 1600° C.

The higher plaque surface temperature means that the plaque material must be a very good thermal insulator to prevent soak back of heat, which can lead to premature ignition (light-back) and so ceramic fibre plaques have been selected. In this particular example, the ceramic fibre plaques used are those sold under Tennaglo by Morgan Ceramic. These have the properties outlined above and further incorporate substantial amounts of alumina which we believe may provide a catalytic stabilising effect at the exceptionally high plaque temperatures at which this embodiment of burner operates. Alternatively, other catalysts such as platinum or palladium may be deposited on the plaques to reduce NOx.

The gas burners 22 are mounted directly in the fibre cowl 26 so that no metal components (of the burner assembly) are exposed to the very high temperatures in the combustion chamber 28. This minimises heat losses by conduction, substantially reduces any possibility of light-back due to overheating of the burner structure, and reduces the stresses on the plaque material, thereby preventing cracking (which can lead to light-back) and prolonging burner life.

A further benefit of this construction is that the acoustic properties of the cowl material substantially reduce burner noise, which can be a problem with this type of burner when mounted in a metal burner housing.

The narrow gap 32 between the inner surface of cowl 26 and the generator 14 is designed to promote high shear forces and convective heat transfer between the combustion product gases and the surfaces. The narrow gap 32 also substantially reduces skewing of the gas flow due to buoyancy.

In order to optimise the heat recovery process, it is important to prevent cool air being entrained into the space between the cowl 26 and the generator 14 at the outer end of the gap 32 which can occur as a result of back circulation of the gas flow. Accordingly, in this embodiment the cowl terminates adjacent a surface of the heat pump housing 10 which ensures that the flow at the cowl exit is substantially parallel to the axis A, thereby reducing or minimizing the radial velocity component.

It is important to ensure that the cowl is assembled such that eccentricity between the cowl 26 and the rotary housing 10 is minimised, as eccentricity can also result in back entrainment of air.

In order to realise these heat recovery benefits, it is important to ensure that the cowl is manufactured to reasonably precise tolerances. The cowl 26 is formed from a high temperature mineral wool material (similar to ceramic fibre) using a vacuum forming process from a suitable slurry of mineral wool fibres. We have found that this method allows the cowl shape to be formed to a sufficiently close tolerance to provide the gap size and concentricity required.

To maintain the cowl concentricity when assembled on the shaft 12, the cowl is formed around the machined metal hub 38 which is attached to perforated sheet metal arms 40 which radiate from the hub. The hub/arm arrangement is located accurately on the vacuum forming tool, prior to immersing the tool into a bath of mineral wool fibre slurry. The entire assembly is then removed from the bath, taken off the tool and dried. To prevent distortion during the drying process, a metal shape (not shown) which corresponds accurately to the corresponding surfaces of the heat pump housing 10 is inserted as a drying former. The finished cowl is then mounted concentrically by locating the hub to the machine shaft by means of suitable bearings 42.

Figure 2:
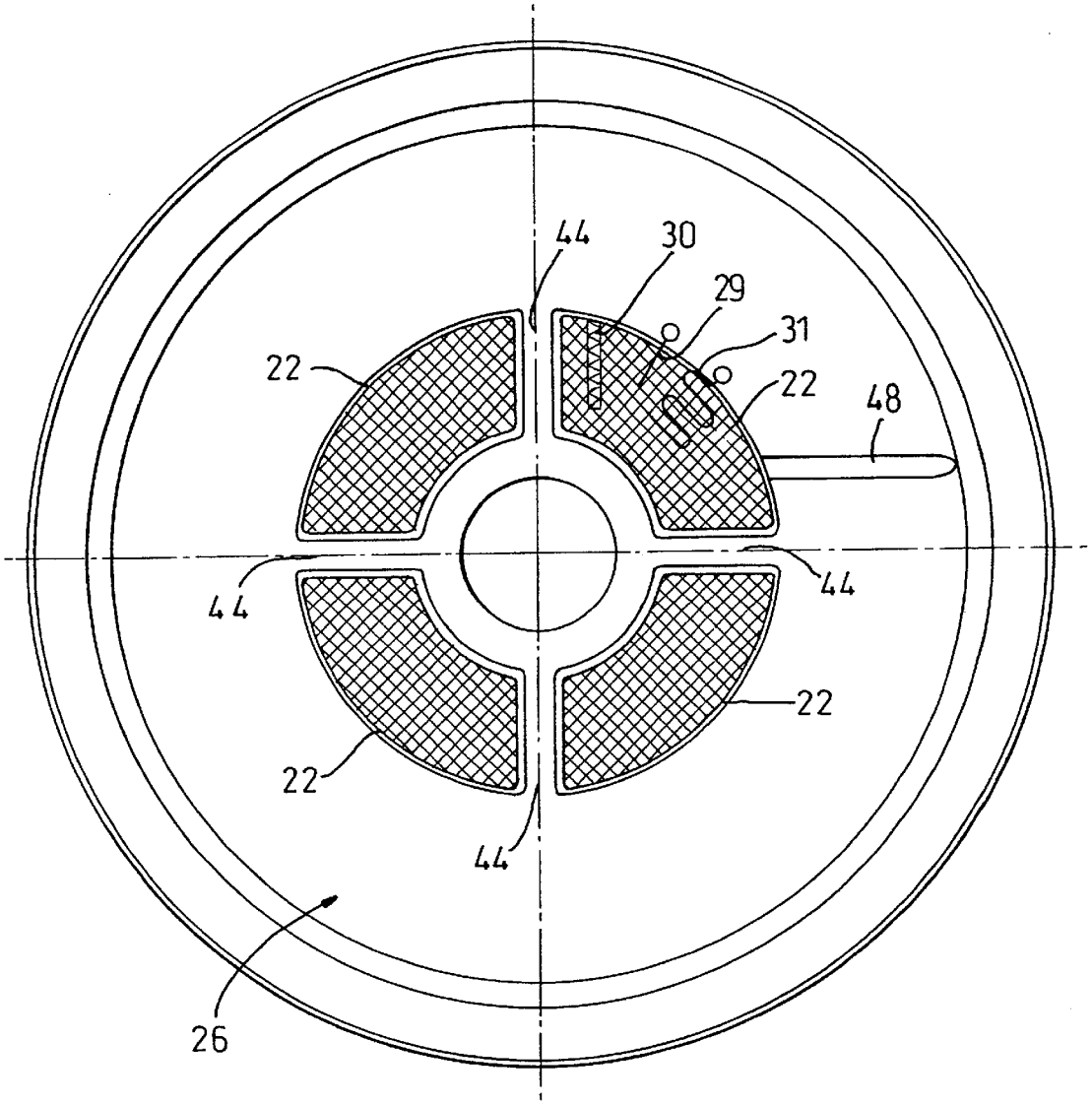
FIG. 2 is an end view on the inner surface of the burner cowl.

In operation one of the burners 22 operates as a pilot or ignition burner. The hot surface igniter element 28 is sited in front of this burner, which also has a flame current rectification flame sensor 29 sited directly in front of and close to the plaque 24 (see FIG. 2). Since there are no metal parts exposed to the combustion chamber, an additional earth metal electrode 31, ideally having at least four times the surface area of the sensor electrode, is required. Both of these are mounted either through the cowl wall or in suitable conduits running through the burner 22 and the plaque 24.

The system requires that the other burners cross-light off the pilot burner and this is achieved provided there is sufficient space between the cowl and the generator in front of the ribs 44 which separate the burners 22.

Modulation of the burner throughput can be achieved either by switching burners on and off, or by varying the flow to the burners using an air valve or a variable speed blower. The air/gas ratio must be maintained close to a constant value and this can be achieved in conventional manner using a servo-regulating gas valve controlled by the combustion air pressure.

Referring now to the optical sensor 44, this has been designed to provide a safety lock-out feature on the burner under certain conditions indicating malfunction of the burner and/or the heat pump. One of the most critical malfunctions is a lack of a flow of working fluid over the inner surface of the generator 14. In this event, the generator face temperature will rise and unless the burner is switched off in time, potentially destructive damage could occur to the heat pump. The device 34 uses an optical sensor 44, such as a photodiode, connected to a borosilicate light guide 46 to isolate the photodiode from extreme temperatures. The light guide 46 is located in a radial bore 48 in the cowl 26 which extends into the pilot combustion chamber 28. When the burner is alight, the sensor 34 will be activated by radiation (both infra-red and visible light) in the combustion chamber. The metal tabs 36 are soldered to the generator face by means of a solder with a melting temperature, in this particular example, of around 300° C. As the rotary heat pump housing rotates relative to the stationary cowl, the tabs 36 will interrupt the light path as they pass in front of the end of the sensing bore 48. The sensor can therefore be used to generate a pulsed signal to a control circuit or processor 60. If the generator face overheats, the solder will melt, causing the tabs 36 to fall off thus altering the modulation to the pulsed signal. The control circuit may then close the main gas valve and shut off the burner.

On start up, the light generated by the hot surface igniter is sufficient to activate the sensor. The control circuit will then know that the machine is rotating, with tabs in place, and will allow the burner ignition to proceed.

The optical sensing system may be responsive to other machine parameters, such as pressure, temperature, fluid concentration, etc., by suitable design of the tabs, or providing an alternative sensor or sensing element which detects a condition and causes a distinctive modulation of the signal seen by the sensor 44. Also, the sensor may be re-setting, for example a bi-metal strip.

What is claimed is:

1. A burner assembly comprising:

a rotary housing mounted for rotation about a rotation axis and defining a heat-receiving surface for receiving heat;

one or more radiant burner devices spaced from and directed towards said heat-receiving surface; and a cowl means disposed around said burner device or devices, and projecting towards said heat-receiving surface to define a generally enclosed combustion chamber and thereafter extending closely spaced from said surface to define a narrow gap through which a burner efflux may pass, wherein said cowl means is constrained against rotation with said housing.

2. A burner assembly according to claim 1, wherein said cowl means includes a cowl element formed of a mineral wool, ceramic fibre material or other heat resistant material.

3. A burner assembly according to claim 2, wherein said cowl element is made by vacuum-forming from a slurry of mineral wool fibres.

4. A burner assembly according to any of claim 1, wherein said cowl means includes a reinforcing member for being rotatably coupled to said housing, or a shaft attached thereto.

5. A burner assembly according to claim 4, wherein the reinforcing member comprises a central stub or shaft portion from which project a plurality of generally radial reinforcing elements, which extend towards said heat-receiving surface.

6. A burner assembly according to claim 5, wherein the reinforcing member and elements are made of metal.

7. A burner assembly according to claim 1, wherein the or each burner device is attached to and supported by said cowl means.

8. A burner assembly according to claim 7, wherein the or each burner device is disposed between adjacent reinforcing elements.

9. A burner assembly according to any of claim 1, wherein the periphery of the cowl means terminates adjacent a surface of the housing which extends generally axially, thereby defining an annular outlet whereby the burner afflux exhausts with a substantial axial component.

10. A burner assembly according to claim 9, wherein said narrow gap extends for at least a third of the radial dimension of the cowl.

11. A burner assembly according to claim 1, wherein the inner walls of the cowl means extend generally axially, closely to surround the radiant surface of said radiant burner device or devices.

12. A burner assembly according to claim 1, wherein the average axial spacing $D_A$ of the front surface of the radiant device or devices from the facing surface of the heat-receiving surface is between about 30% and 70% of the radial dimension $D_R$ of the heat emitting surface of the burner device.

13. A burner assembly according to claim 1, further including sensor means for detecting radiation in said combustion chamber and processor means responsive to the output of said sensor to monitor operation of said assembly.

14. A burner assembly comprising a combustion chamber including burner means for producing radiant heat, a rotary housing defining a heat-receiving surface for receiving heat from said chamber, and a sensor means constrained against rotation with said rotary housing for detecting radiation in said chamber, and processor means responsive to the amplitude of or modulation of said detected radiation to monitor operation of said assembly.

15. A burner assembly according to claim 14, wherein the heat-receiving surface has one or more tab elements projecting therefrom and formed of a fusible material or secured to the heat receiving surface by a fusible material and disposed such that, on rotation of said housing, the burner means radiation is modulated by said tab elements, whereby the detected modulation alters if said fusible material fuses or begins to fuse.

16. A burner assembly according to claim 15, wherein said burner means includes an igniter element, and the igniter, the tab elements, and the optical sensor are disposed such that, on actuation of said igniter means, the corresponding modulation in the output signal of the optical sensors may be used by said processor to monitor both correct operation of the igniter means and to check for previous overheating of the heat-receiving surface.

* * * * *